US010734764B2

(12) United States Patent
Ghannam et al.

(10) Patent No.: US 10,734,764 B2
(45) Date of Patent: Aug. 4, 2020

(54) VEHICLE CONNECTORS FOR MONITORING CONNECTION WITH TRAILER CONNECTORS

(71) Applicant: Ford Global Technologies, LLC, Dearborn, MI (US)

(72) Inventors: Mahmoud Yousef Ghannam, Canton, MI (US); Joel Allen Pittenger, Rochester Hills, MI (US); Aed M. Dudar, Canton, MI (US); Swadad A. Carremm, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/149,717

(22) Filed: Oct. 2, 2018

(65) Prior Publication Data

US 2019/0036275 A1 Jan. 31, 2019

Related U.S. Application Data

(63) Continuation of application No. 15/385,730, filed on Dec. 20, 2016, now Pat. No. 10,103,488.

(51) Int. Cl.
*H01R 33/00* (2006.01)
*H01R 13/641* (2006.01)
(Continued)

(52) U.S. Cl.
CPC ..... *H01R 13/641* (2013.01); *H01R 13/05* (2013.01); *H01R 13/11* (2013.01);
(Continued)

(58) Field of Classification Search
CPC .... H01R 13/64; H01R 13/6205; H01R 13/24; H01R 24/60; H01R 11/30; H01R 13/6271; H01R 13/665; H01R 13/53
(Continued)

(56) References Cited

U.S. PATENT DOCUMENTS 2,583,122 A * 1/1952 Rousseau ..... H01H 71/52 200/325
3,080,646 A * 3/1963 Petri ..... B01D 27/005 29/252
3,524,562 A * 8/1970 Fuzzell ..... E02F 3/432 414/699
4,182,186 A * 1/1980 Hirsch ..... B26D 3/14 83/468.8
(Continued)

FOREIGN PATENT DOCUMENTS

DE 2020005017201 U1 8/2006
DE 202011105552 U1 9/2012
(Continued)

OTHER PUBLICATIONS

Search Report dated May 3, 2018 for GB Patent Application No. GB 1721269.7 (3 Pages).

*Primary Examiner* — Jean F Duverne

(74) *Attorney, Agent, or Firm* — Frank Lollo; Eversheds Sutherland (US) LLP

(57) ABSTRACT

Apparatus are disclosed for vehicle connectors for monitoring connection with trailer connectors. An example connector of a vehicle for coupling a trailer to the vehicle includes a wall defining a cavity to receive a trailer connector, a seal to engage the trailer connector when the cavity receives the trailer connector, and a first trailer-connection sensor disposed in the seal to monitor engagement of the trailer connector with the seal to identify a secure connection with the trailer connector.

15 Claims, 7 Drawing Sheets

(51) Int. Cl.

| | |
|---|---|
| ***H01R 13/52*** | (2006.01) |
| ***H01R 13/703*** | (2006.01) |
| ***H01R 13/05*** | (2006.01) |
| ***H01R 13/11*** | (2006.01) |
| ***H01R 13/66*** | (2006.01) |
| ***H01R 13/707*** | (2006.01) |
| ***H01R 24/22*** | (2011.01) |
| ***H01R 24/70*** | (2011.01) |
| *H01R 107/00* | (2006.01) |
| *H01R 24/86* | (2011.01) |

(52) U.S. Cl.
CPC ..... *H01R 13/5219* (2013.01); *H01R 13/665* (2013.01); *H01R 13/703* (2013.01); *H01R 13/707* (2013.01); *H01R 24/22* (2013.01); *H01R 24/70* (2013.01); *H01R 24/86* (2013.01); *H01R 2107/00* (2013.01); *H01R 2201/26* (2013.01)

(58) Field of Classification Search
USPC ..... 439/35
See application file for complete search history.

(56) References Cited

U.S. PATENT DOCUMENTS

| | | | | |
|---|---|---|---|---|
| 5,112,246 | A | 5/1992 | Kawase | |
| 5,434,552 | A * | 7/1995 | Ems | B60D 1/06 280/432 |
| 6,811,419 | B2 | 11/2004 | Bure | |
| 6,863,538 | B2 | 3/2005 | Mattern | |
| 7,749,007 | B1 * | 7/2010 | Gilliam | H01R 13/53 439/188 |
| 7,850,482 | B2 | 12/2010 | Montena | |
| 9,246,270 | B2 * | 1/2016 | Toratani | B60L 11/1816 |
| 9,960,558 | B2 * | 5/2018 | Ocegueda Gallaga | A47G 33/06 |
| 2004/0262314 | A1 | 12/2004 | Weatherhead | |
| 2013/0102162 | A1 | 4/2013 | Holmes | |
| 2016/0072266 | A1 | 3/2016 | Bulancea | |
| 2017/0077634 | A1 | 3/2017 | Markefka | |

FOREIGN PATENT DOCUMENTS

| | | | |
|---|---|---|---|
| DE | 102015102791 | U1 | 9/2016 |
| DE | 102015214280 | A1 | 2/2017 |

* cited by examiner

VEHICLE CONNECTORS FOR MONITORING CONNECTION WITH TRAILER CONNECTORS

CROSS-REFERENCE TO RELATED APPLICATIONS

This application is a continuation of U.S. patent application Ser. No. 15/385,730 filed on Dec. 20, 2016, which will issue as U.S. Pat. No. 10,103,488 on Oct. 16, 2018, which is hereby incorporated by reference in its entirety.

TECHNICAL FIELD

The present disclosure generally relates to trailers and, more specifically, trailer-vehicle connection detection via a receptacle sensor.

BACKGROUND

Generally, vehicles include storage areas (e.g., trunks, truck beds, etc.) to store objects. In some instances, a driver and/or a passenger of the vehicle may have an object that is unable to fit within the storage area of the vehicle. In such instances, a trailer may be utilized to store and transport the object. Typically, the trailer that stores the object is connected to a rear of the vehicle to enable the vehicle to tow the trailer and the object stored within the trailer as the vehicle travels along a road.

SUMMARY

The appended claims define this application. The present disclosure summarizes aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

Example embodiments are shown for vehicle connectors for monitoring connection with trailer connectors. An example disclosed connector of a vehicle for coupling a trailer to the vehicle includes a wall defining a cavity to receive a trailer connector, a seal to engage the trailer connector when the cavity receives the trailer connector, and a first trailer-connection sensor disposed in the seal to monitor engagement of the trailer connector with the seal to identify a secure connection with the trailer connector.

An example disclosed vehicle includes a connector to receive a trailer connector. The connector includes a seal to engage the trailer connector, a first sensor disposed in the seal to detect a connection between the connector and the trailer connector, and a first switch operatively coupled to the first sensor. that actuates when the connection is detected to close an electrical circuit. The example disclosed vehicle also includes a display that indicates a secure coupling when the electrical circuit is close.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1:
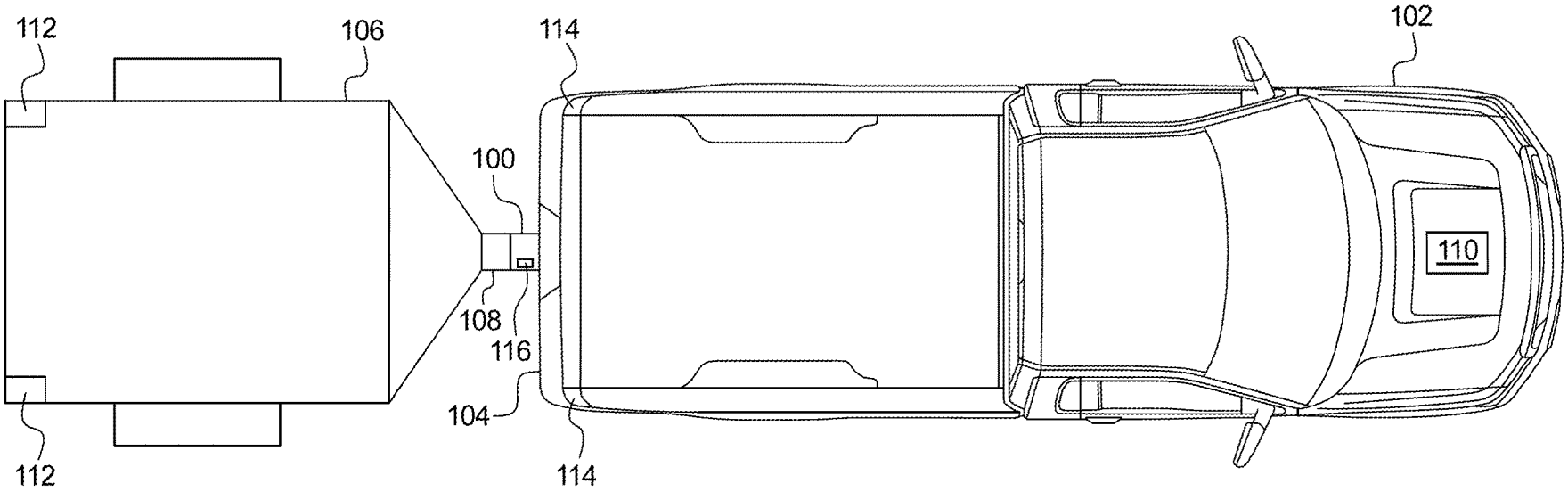
FIG. 1 illustrates a trailer coupled to a vehicle via an example connector in accordance with the teachings herein.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

Generally, vehicles include storage areas (e.g., trunks, truck beds, etc.) to store objects. In some instances, a driver and/or a passenger of the vehicle may have an object that is unable to fit within the storage area of the vehicle. In such instances, a trailer may be utilized to transport the object from one location to another location. Typically, the trailer is connected to a rear of the vehicle to enable the vehicle to tow the trailer and the object stored within the trailer as the vehicle travels along a road.

Some vehicles includes a plug or male connector located at the rear of the vehicle that couples to receptacle or female connector of the trailer to couple the trailer to the vehicle. In such instances, the trailer potentially may block taillights of the vehicle from being viewed by drivers of other vehicles. To enable those other drivers to identify when the vehicle towing the trailer is stopping, some trailers include taillights that are electrically coupled to the taillights of the vehicle. To electrically couple the taillights of the trailer to electrical components of the vehicle, the connector of the trailer may include electrical sockets that receive electrical prongs of the connector of the vehicle when the connectors are coupled together.

Sometimes, it potentially may be difficult for a driver and/or another user of a trailer to identify whether the connector of the trailer is securely fastened to the connector of the vehicle. To facilitate a user in identifying securely fastened connectors, some vehicles include a circuit that is to indicate a secure fastening based on whether the electrical plugs of the connector of the vehicle are identified as being coupled to other electrical components (e.g., the electrical sockets of the connector of the trailer). In some instances, an electrical continuity between the electrical plugs may be affected as a result of being exposed to moisture and/or other adverse material over time (e.g., rust may form and/or dust may collect from adverse weather conditions) and, thus, potentially may cause the circuit to indicate that a trailer is coupled to the trailer when no trailer is present.

Examples vehicle connectors disclosed herein include sealed trailer-connection sensors that monitor engagement of a trailer connector with the vehicle connector seal to identify a secure connection between vehicle connector and the trailer connector. Some examples vehicle connectors disclosed herein include a plurality of sealed trailer-connection sensors to identify when the trailer connector is misaligned with and/or partially inserted into the vehicle connector such that a secure connection is not formed between the vehicle connector and the trailer connector.

As used herein, a "secure connection," a "secure coupling," and a "secure fastening" refers to a connection between a vehicle connector and a trailer connector that enables the vehicle to tow the trailer and that remains until a user performs a predetermined action (e.g., unlock the connectors) to disconnect the trailer connector from the vehicle connector. As used herein, a "sealed sensor" refers to a sensor that is enclosed or includes a sensing component(s) that is enclosed within and/or by a seal to deter the sensor and/or the sensing component(s) from being exposed to moisture.

Example connectors of a vehicle disclosed herein include a wall defining a cavity in which electrical prongs are disposed. The cavity of the vehicle connector is to receive a trailer connector to couple a trailer to the vehicle. For example, the electrical prongs disposed in the cavity are to electrically couple components of the trailer to a vehicle power source when the trailer connector is coupled to the vehicle connector. A seal is to engage the trailer connector when the trailer connector is inserted into the cavity to couple to the vehicle connector. In some examples, the seal extends along at least a portion of the outer wall to seal the cavity when the trailer connector is inserted into the cavity.

Further, a first trailer-connection sensor is disposed in the seal to be sealed from moisture and/or other adverse material. The first trailer-connection sensor monitors engagement of the trailer connector with the seal and/or detects a connection between the vehicle connector and the trailer connector to identify a secure connection between the trailer connector and the vehicle connector. In some examples, the first trailer-connection sensor includes a first gauge (e.g., a strain gauge, a stress gauge). In some examples in which the first gauge is a strain gauge, the first gauge includes a plurality of sensors.

Examples disclosed herein also include an electrical circuit that includes a first switch operatively coupled to the first trailer-connection sensor. In such examples, the first switch actuates to close the electrical circuit when the first trailer-connection sensor detects the connection and/or engagement between the trailer connector and the seal. That is, the electrical circuit being close (e.g., via the closed first trailer-connection sensor indicates a secure connection between the trailer connector and the vehicle connector. For example, the first switch is calibrated to actuate when the trailer connector is securely inserted into the cavity. In some examples, the vehicle includes a display and/or a speaker. The display and/or the speaker indicates to a driver that there is a secure coupling when the electrical circuit is close.

In some examples, the vehicle connector also includes a second trailer-connection sensor disposed in the seal and spaced apart from the first trailer-connection sensor. The second trailer-connection sensor is disposed in the seal to be sealed from moisture and/or other adverse material. In some examples, the second trailer-connection sensor includes a second gauge (e.g., a strain gauge, a stress gauge). In such examples, the first trailer-connection sensor is to monitor a first portion of engagement and/or a connection between the trailer connector and the seal, and the second trailer-connection sensor is to monitor a second portion of engagement and/or a connection between the trailer connector and the seal. For example, the second trailer-connection sensor is operatively coupled to a second switch of the electrical circuit that actuates to close the electrical circuit when the second trailer-connection sensor detects the trailer connector. Thus, the combination of the first trailer-connection sensor and the second trailer-connection sensor enable misalignment between the trailer connector and the vehicle sensor and/or partial insertion of the trailer connector into the vehicle connector to be detected.

Additionally or alternatively, the vehicle includes one or more trailer-connection sensors (e.g., a third trailer-connection sensor) that are disposed in the cavity and spaced apart from the seal. For example, a third trailer-connection sensor (e.g., a spring-loaded pushpin) is to monitor a third portion of engagement and/or a connection with the trailer connector. The third trailer-connection sensor is operatively coupled to a third switch of the electrical circuit that actuates to close the electrical circuit when the third trailer-connection sensor detects the trailer connector. Thus, the third trailer-connection sensor further enables misalignment and/or partial insertion to be detected.

Turning to the figures, FIG. 1 illustrates an example vehicle connector 100 of a vehicle 102 (e.g., a pickup truck) in accordance with the teachings herein. The vehicle 102 may be a standard gasoline powered vehicle, a hybrid vehicle, an electric vehicle, a fuel cell vehicle, and/or any other mobility implement type of vehicle. The vehicle 102 includes parts related to mobility, such as a powertrain with an engine, a transmission, a suspension, a driveshaft, and/or wheels, etc. The vehicle 102 may be non-autonomous, semi-autonomous (e.g., some routine motive functions controlled by the vehicle 102), or autonomous (e.g., motive functions are controlled by the vehicle 102 without direct driver input).

As illustrated in FIG. 1, the vehicle connector 100 of the vehicle 102 is positioned on a rear side 104 of the vehicle 102. A trailer 106 couples to the vehicle 102 via the vehicle connector 100 to enable the vehicle 102 to tow the trailer 106. In the illustrated example, the trailer 106 includes a trailer connector 108 that connects to the vehicle connector 100 to couple the trailer 106 to the vehicle 102. For example, the vehicle connector 100 is a plug (e.g., a male connector) and the trailer connector 108 is receptacle (e.g., a female connector) that receives the plug. In other examples, the trailer connector 108 is a plug and the vehicle connector 100 is a receptacle that receives the plug.

In the illustrated example, the vehicle connector 100 includes electrical prongs (e.g., electrical prongs 306 of FIG. 3) and the trailer connector 108 include corresponding electrical sockets that receive the electrical prongs when the trailer connector 108 is securely connected to the vehicle 102. The electrical prongs of the vehicle 102 are received the electrical sockets of the trailer 106 to electrically couple a power source 110 of the vehicle 102 to electrical components of the trailer 106. For example, when trailer 106 is coupled to the vehicle 102 via the trailer connector 108 and the vehicle connector 100, the power source 110 provides power to taillights 112 of the trailer 106. Because the trailer 106 is located behind the vehicle 102, the trailer 106 potentially may impede other drivers from viewing taillights 114 of the vehicle 102 that indicate when the vehicle 102 is stopping and/or otherwise braking. Thus, the taillights 112 of the trailer 106 enable other drivers to identify when the vehicle 102 and the trailer 106 when the vehicle 102 is stopping and/or otherwise braking.

Further, as illustrated in FIG. 1, the vehicle connector 100 includes an electrical circuit 116 that identifies whether the trailer connector 108 of the trailer 106 is securely connected to the vehicle connector 100 of the vehicle 102. For example, the electrical circuit 116 monitors a connection between the vehicle connector 100 and the trailer connector 108 to verify that the trailer connector 108 is securely connected to the vehicle connector 100 and/or to verify that the power source 110 of the vehicle 102 is providing power to the taillights 112 of the trailer 106. In the illustrated example, the vehicle 102 provides an indication to the driver of the vehicle 102 in response to the electrical circuit 116 identifying that the trailer connector 108 is securely connected to the vehicle connector 100. For example, the vehicle 102 includes a display 118 that presents a visual indicator and/or a speaker 120 that provides an audio signal identifying that the trailer 106 is securely connected to the vehicle 102 (e.g., when the electrical circuit is close).

Figure 2:
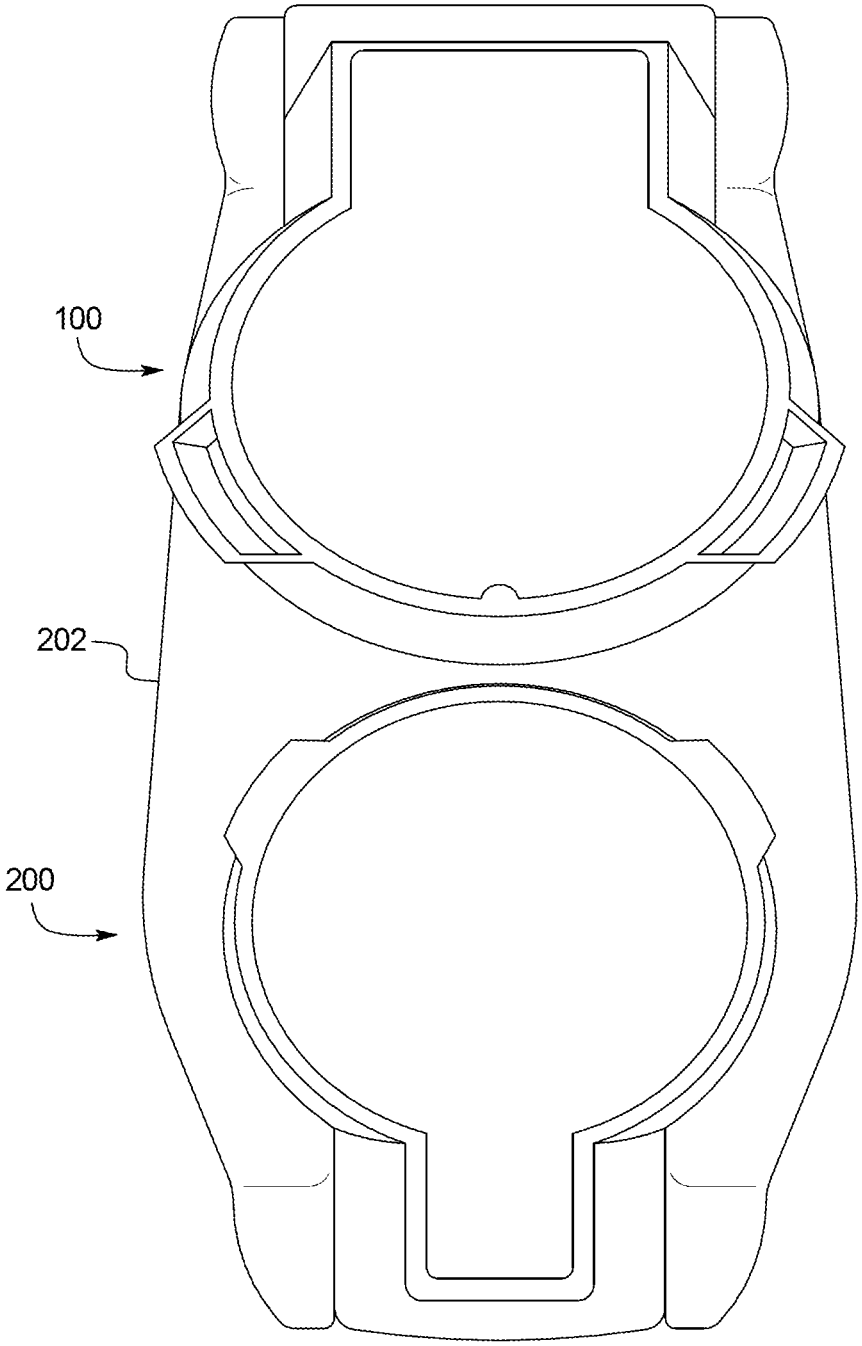
FIG. 2 illustrates the connector of FIG. 1 when closed.

FIG. 2 illustrates the vehicle connector 100 and another vehicle connector 200 of the vehicle 102. As illustrated in FIG. 2, each of the vehicle connectors 100, 200 are included in a connector housing 202. The connector housing 202 is coupled to the rear side 104 of the vehicle 102 so that the vehicle connectors 100, 200 are located at the rear side 104 of the vehicle 102. The vehicle connector 200 is substantially similar or identical to the vehicle connector 100 that is disclosed in detail below. Thus, some components of the vehicle connector 200 will not be described in detail below.

In the illustrated example, the vehicle connector 100 includes a cover 204 that is coupled to the connector housing 202 via a hinge 206, and the vehicle connector 200 includes a cover 208 that is coupled to the connector housing 202 via a hinge 210. In the illustrated example, each of the covers 204, 208 of the respective vehicle connectors 100, 200 is in a closed position. The covers 204, 208 cover the respective vehicle connectors 100, 200 in the closed position to protect electrical components (e.g., the electrical circuit 116, the electrical prongs 306) and/or mechanical components from moisture and/or other adverse material when the vehicle connectors 100, 200 are not being utilized to connect an object (e.g., the trailer 106) to the vehicle 102.

Figure 3:
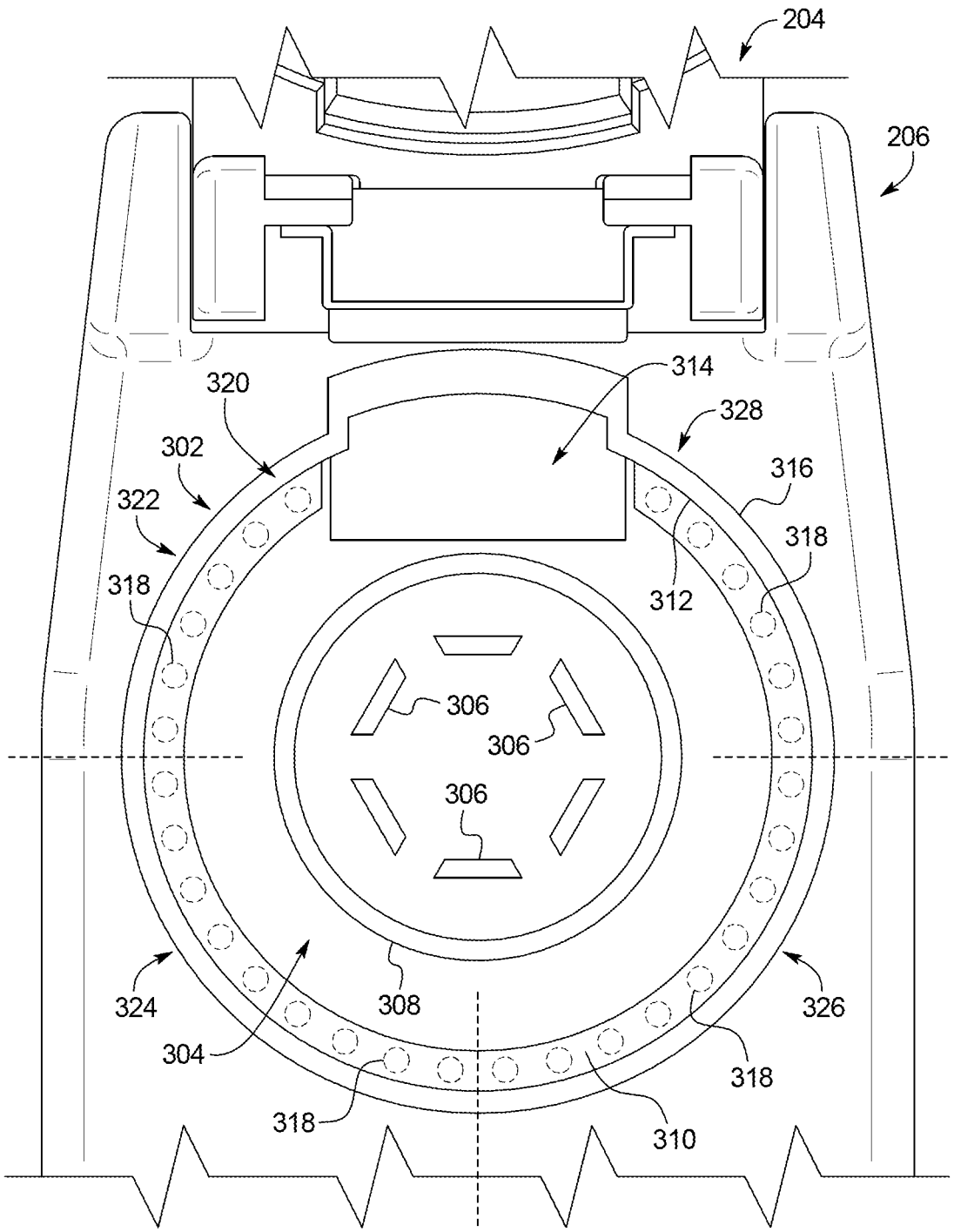
FIG. 3 illustrates the connector of FIG. 1 when opened.

FIG. 3 illustrates the vehicle connector 100 when the cover 204 is in an open position to enable the vehicle connector 100 to receive the trailer connector 108. The vehicle connector 100 includes a wall 302 (e.g., an outer wall) that defines a cavity 304 of the vehicle connector 100. The cavity 304 of the vehicle connector 100 receives the trailer connector 108 to couple the trailer 106 to the vehicle 102 via the vehicle connector 100 and the trailer connector 108. As illustrated in FIG. 3, electrical prongs 306 are disposed or located in cavity 304. The electrical prongs 306 are received by the corresponding electrical sockets of the trailer connector 108 to electrically couple the power source 110 of the vehicle 102 to the electrical components (e.g., the taillights 112) of the trailer 106 when the trailer connector 108 couples to the vehicle connector 100. In the illustrated examples, the vehicle connector 100 includes six of the electrical prongs 306. In other examples, more or less of the electrical prongs 306 may be included in the vehicle connector 100. Further, vehicle connector 100 includes another wall 308 that is disposed in the cavity 304 and is located between the wall 302 and the electrical prongs 306. For example, the wall 308 of the vehicle connector 100 facilitates alignment and/or a secure connection between vehicle connector 100 and the trailer connector 108.

In the illustrated example, the vehicle connector 100 includes a seal 310 that engages the trailer connector 108 when the trailer connector 108 is inserted into the cavity 304. The trailer connector 108 is to sealingly engage the seal 310 to seal the electrical components of the vehicle connector 100 (e.g., the electrical prongs 306, the electrical circuit 116) and/or of the trailer connector 108 (e.g., the electrical sockets) from moisture and/or other adverse materials when the trailer connector 108 is coupled to the vehicle connector 100. As illustrated in FIG. 3, the seal 310 is adjacent to the wall 302 to seal the cavity 304 of the vehicle connector 100. The seal 310 extends along at least a portion of the circumference of the wall 302. In the illustrated example, the seal 310 extends from a first side of a groove 314 to an opposing second side of the groove 314. The groove 314 of the vehicle connector 100 facilitates alignment with the trailer connector 108 when the trailer connector 108 is inserted into the cavity 304 of the vehicle connector 100. In other examples, the seal 310 extend along the circumference of the wall 302 to further seal the electrical components of the vehicle connector 100 from moisture and/or other adverse materials. Further, the seal 310 of the illustrated example extends along an inner surface 312 of the wall 302 to seal the cavity 304. In other examples, the seal 310 extends along an outer surface 316 to seal the cavity 304.

As illustrated in FIG. 3, one or more sensors 318 are disposed in the seal 310. The sensors 318 monitor engagement of the trailer connector 108 with the seal 310 to detect when there is a secure connection between the vehicle connector 100 and the trailer connector 108. For example, the sensors 318 are strain gauges, stress gauges, and/or any other type of sensors that monitor the engagement between the trailer connector 108 and the seal 310. Further, the sensors 318 of the illustrated example are disposed in the seal 310 to protect the sensors 318 from moisture and/or other adverse material. For example, the sensors 318 are positioned on a film 320 (e.g., a plastic film) that is embedded in (e.g., via over-molding) and/or pressed between two layers of the seal 310 to position the sensors 318 within the seal 310. In the illustrated example, the sensors 318 are disposed in the seal 310 that protects the electrical components of the vehicle connector 100 from moisture and/or other adverse material. In other examples, the sensors 318 may be disposed in another structure (e.g., a flexible sensor housing) that does not seal the electrical components of the vehicle connector 100.

The sensors 318 of the illustrated example are calibrated so that the corresponding switch actuates when the vehicle connector 100 is securely connected to the trailer connector 108. For example, when the vehicle connector 100 is securely connected to the trailer connector 108, the trailer connector 108 remains connected to the vehicle connector 100 until a user disconnect the trailer connector 108 from the vehicle connector 100, the trailer connector 108 is sealingly coupled to the seal 310 of the vehicle connector 100, and the electrical prongs 306 of the vehicle connector 100 are electrically connected to the electrical sockets of the trailer connector 108.

In the illustrated example, the sensors 318 are clustered together into trailer-connection sensors. For example, a first trailer-connection sensor 322 includes one or more of the sensors 318 (e.g., a first strain gauge including a plurality of strain sensors) that are operatively connected together, a second trailer-connection sensor 324 includes one or more of the sensors 318 (e.g., a second strain gauge including a plurality of strain sensors) that are operatively connected together, a third trailer-connection sensor 326 includes one or more of the sensors 318 (e.g., a third strain gauge including a plurality of strain sensors) that are operatively connected together, and a fourth trailer-connection sensor 328 includes one or more of the sensors 318 (e.g., a fourth strain gauge including a plurality of strain sensors) that are operatively connected together. As illustrated in FIG. 3, each of the trailer-connection sensors 322, 324, 326, 328 are disposed in the seal 310 and are spaced apart from each other. Further, the trailer-connection sensors 322, 324, 326, 328 monitor and/or detect respective first, second, third, and fourth connections (e.g., portions of engagement) between the trailer connector 108 and the seal 310, for example, to identify a secure connection, misalignment, and/or partial insertion between the trailer connector 108 and the vehicle connector 100. While the illustrated example includes four trailer-connection sensors, the vehicle connector 100 may include more or less trailer-connection sensors.

Figure 4A:
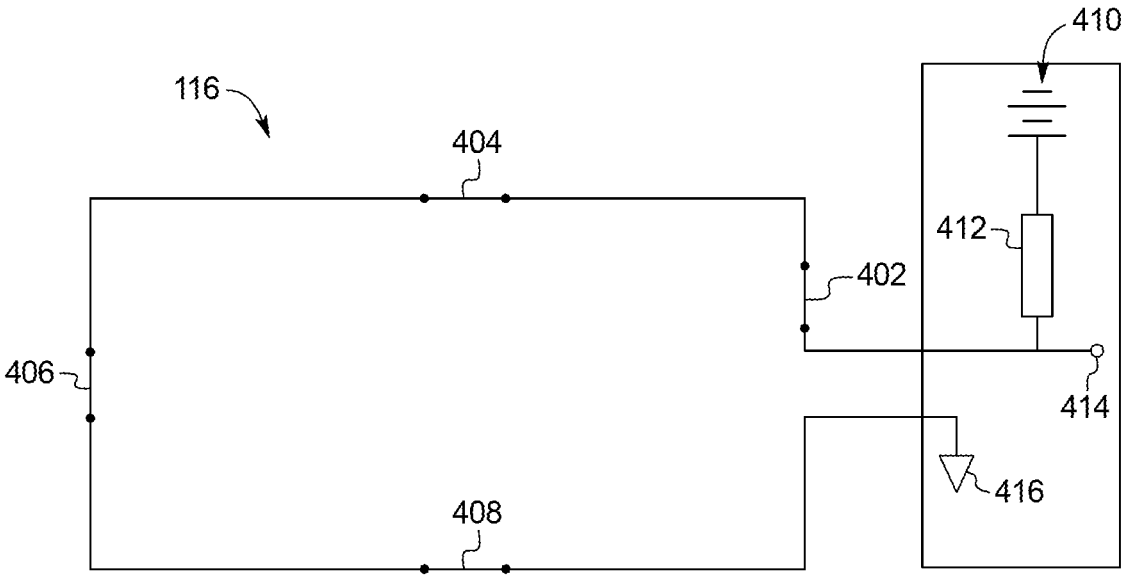
FIG. 4A depicts an electrical circuit of the connector of FIG. 1 in a first state.
Figure 4B:
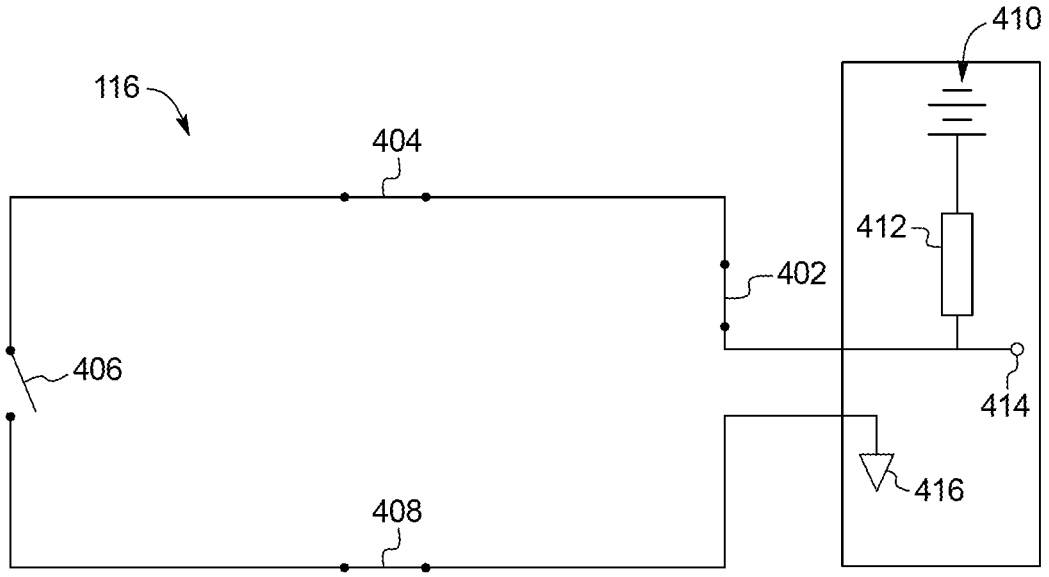
FIG. 4B depicts the electrical circuit of FIG. 4A in a second state.

FIGS. 4A and 4B depict the electrical circuit 116 that detects whether the trailer connector 108 of the trailer 106 is securely connected to the vehicle connector 100 of the vehicle 102. In the illustrated example, the electrical circuit includes four switches 402, 404, 406, 408 connected together in series. The first switch 402 is operatively coupled to the first trailer-connection sensor 322, the second switch 404 is operatively coupled to the second trailer-connection sensor 324, the third switch 406 is operatively coupled to the third trailer-connection sensor 326, and the fourth switch 408 is operatively coupled to the fourth trailer-connection sensor 328. For example, when the first trailer-connection sensor 322 identifies that the first portion of the connection between the trailer connector 108 and the seal 310 is secure, the first switch 402 actuates from an open position to a closed position. Similarly, the second switch 404 actuates from an open position to a closed position when the second trailer-connection sensor 324 identifies that the second portion of the connection is secure, the third switch 406 actuates from an open position to a closed position when the third trailer-connection sensor 326 identifies that the third portion of the connection is secure, and the fourth switch 408 actuates from an open position to a closed position when the fourth trailer-connection sensor 328 identifies that the fourth portion of the connection is secure. That is, each of the switches 402, 404, 406, 408 are calibrated to transition to the closed position when the corresponding portion of the connection between the trailer connector 108 and the vehicle connector 100 is secure. While the illustrated example includes four switches, the electrical circuit 116 may include more or less switches.

Further, as illustrated in FIGS. 4A and 4B, the electrical circuit 116 includes a power source 410, a resister 412, an input connection 414, and a ground connection 416. To determine whether the connection between the vehicle connector 100 and the trailer connector 108 is secure, the power source 410 applies a voltage to the electrical circuit 116. If the electrical circuit 116 is closed (i.e., all of the switches 402, 404, 406, 408 are in the closed position) as illustrated in FIG. 4A, the input connection 414 receives a first input indicating that the trailer connector 108 is securely connected to the vehicle connector 100. In such examples, the first input causes the display 118 and/or the speaker 120 of the vehicle 102 to indicate to the driver that the connection is secure. Otherwise, if the electrical circuit 116 is open, the input connection 414 receives a second input indicating that the trailer connector 108 is not securely connected to the vehicle connector 100. For example, as illustrated in FIG. 4B, the third switch 406 associated with the third trailer-connection sensor 326 is open, thereby indicating that the trailer connector 108 is partially inserted into and/or misaligned with the vehicle connector 100. Alternatively, each of the switches 402, 404, 406, 408 being in the open position indicates that there is no trailer connector 108.

Figure 5:
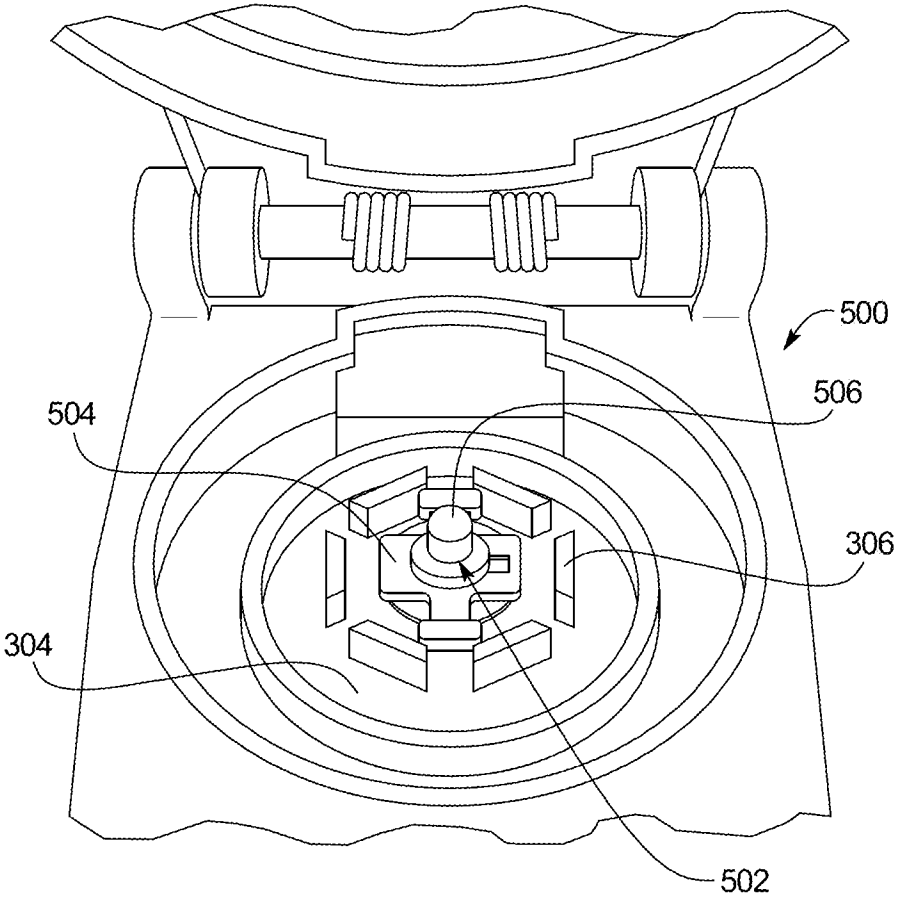
FIG. 5 illustrates another example connector in accordance with the teachings herein.

FIG. 5 illustrates another example vehicle connector 500 in accordance with the teachings herein. Some components of the vehicle connector 500 are substantially similar or identical to the vehicle connector 100 of FIGS. 1-4B. Thus, those components of the vehicle connector 500 will not be described in detail below.

As illustrated in FIG. 5, the vehicle connector 500 includes a pushpin 502 that detects when there is a secure connection between the trailer connector 108 and the vehicle connector 500. Further, the vehicle connector 500 includes a housing 504 that houses the pushpin 502 within the cavity 304 of the vehicle connector 500. In the illustrated example, the housing 504 positions the pushpin 502 centrally within cavity 304 between the electrical prongs 306.

In operation, when the trailer connector 108 is inserted into the cavity 304 of the vehicle connector 500, the trailer connector 108 engages a plunger 506 of the pushpin 502 and causes the plunger 506 to actuate. Further, the pushpin 502 is operatively coupled to a switch (e.g., the first switch 402) of the electrical circuit 116. When the plunger 506 of the pushpin 502 actuates by a calibrated amount, the switch actuates to a closed position to closed the electrical circuit 116 and, thus, to indicate that the trailer connector 108 is securely connected to the vehicle connector 500.

Figure 6:
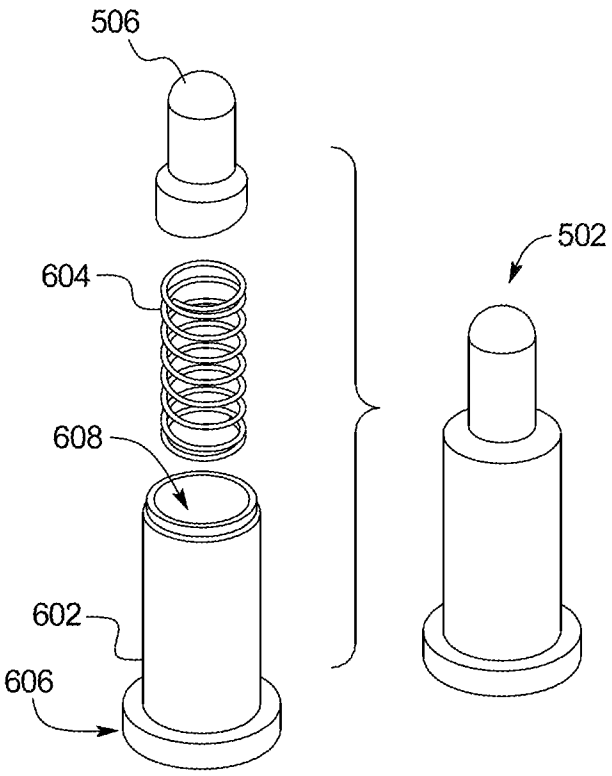
FIG. 6 illustrates a spring-loaded pushpin of the connector of FIG. 5.

FIG. 6 illustrates the pushpin 502 of the vehicle connector 500. As illustrated in FIG. 6, the pushpin 502 is a spring-loaded pushpin that includes the plunger 506, a body 602, a spring 604, and a contact plate 606. The spring 604 is disposed within an opening 608 of the body 602 between the plunger 506 and the contact plate 606. The contact plate 606 and/or other electrical components of the pushpin 502 are sealed to prevent the electrical components of the pushpin 502 from being exposed to moisture and/or other adverse material over time.

When the trailer connector 108 engages the plunger 506, the plunger 506 overcomes a force applied by the spring 604 and moves toward the contact plate 606. When the spring is compressed, the plunger 506 causes the contact plate 606 to actuate the corresponding switch of the electrical circuit 116 to the closed position. For example, the pushpin 502 is calibrated so that the actuation of the switch corresponds to a secure connection between the trailer connector 108 and the vehicle connector 500. Further, when the trailer connector 108 is disconnected from the vehicle connector 500, the spring 604 pushes the plunger 506 away from the contact plate 606 to cause the corresponding switch to actuate to its open position.

Figure 7:
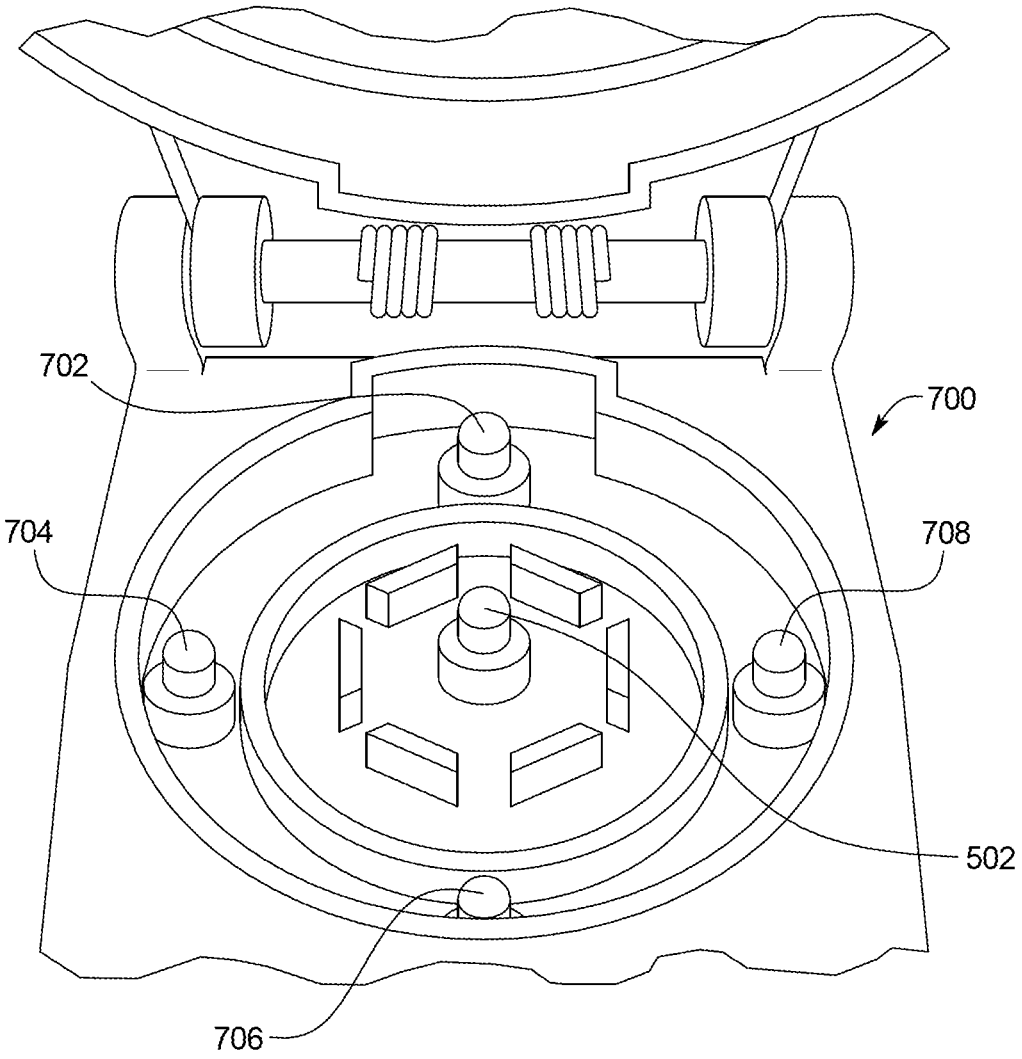
FIG. 7 illustrates another example connector in accordance with the teachings herein.

FIG. 7 illustrates another example vehicle connector 700 in accordance with the teachings herein. Some components of the vehicle connector 700 are substantially similar or identical to the vehicle connector 100 of FIGS. 1-4B and/or the vehicle connector 500 of FIG. 5. Thus, those components of the vehicle connector 700 will not be described in detail below.

As illustrated in FIG. 7, the vehicle connector 700 includes the pushpin 502 (e.g., a first spring-loaded pushpin) and pushpins 702, 704, 706, 708 (e.g., second, third, fourth, and fifth spring-loaded pushpins, respectively). The pushpins 702, 704, 706, 708 includes components that are substantially similar or identical to the pushpin 502. In the illustrated example, the pushpin 502 is operatively coupled to a first switch (e.g., the first switch 402) of the electrical circuit 116, the pushpin 702 is operatively coupled to a second switch (e.g., the second switch 404), the pushpin 704 is operatively coupled to a third switch (e.g., the third switch 406), the pushpin 706 is operatively coupled to a fourth switch (e.g., the fourth switch 408), and the pushpin 708 is operatively coupled to a fifth switch. The pushpins 502, 702, 704, 706, 708 monitor different portions of the connection between the trailer connector 108 and the vehicle connector 700 to facilitate detection of misalignment and/or partial insertion of the trailer connector 108.

Figure 8:
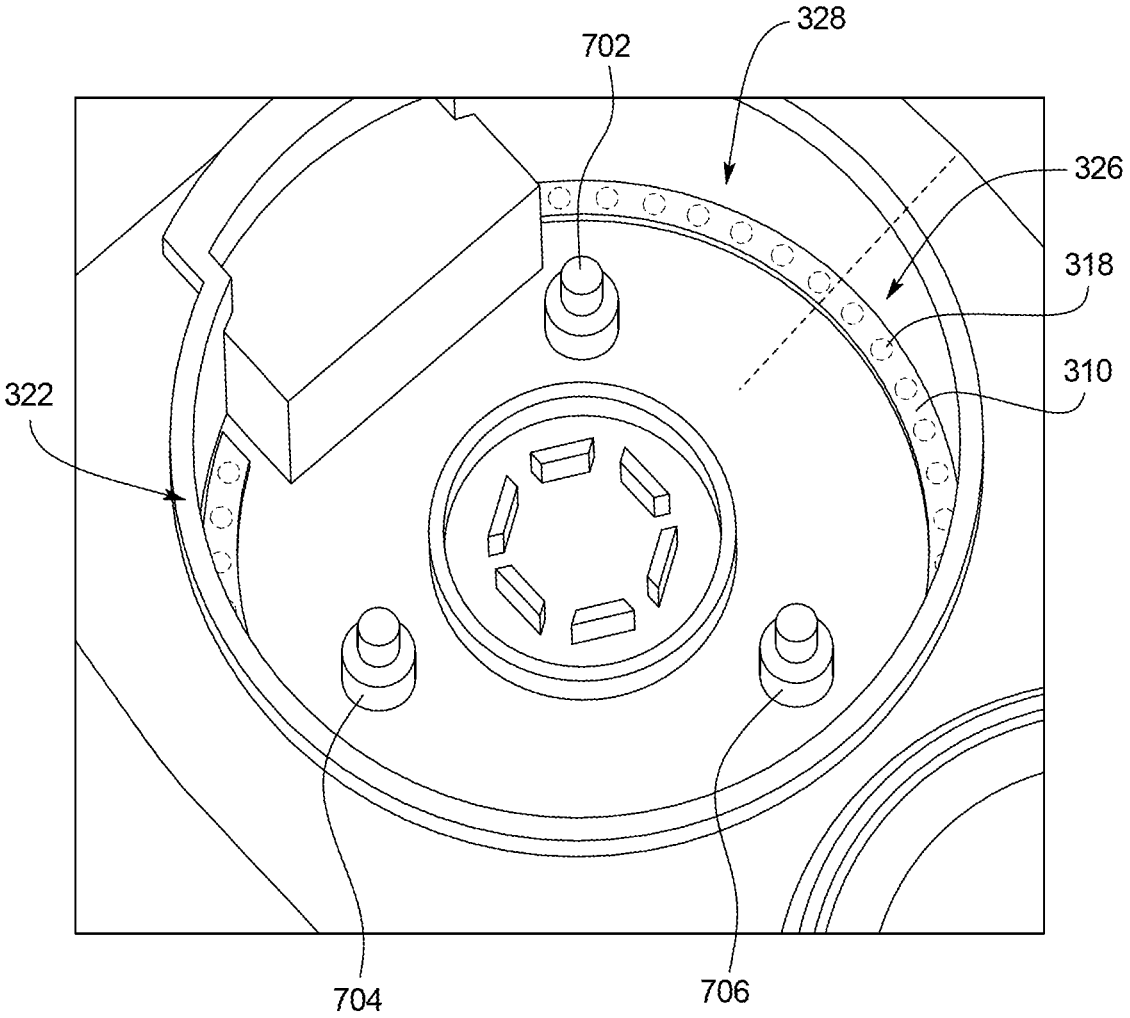
FIG. 8 illustrates another example connector in accordance with the teachings herein.

FIG. 8 illustrates another example vehicle connector 800 in accordance with the teachings herein. Some components of the vehicle connector 800 are substantially similar or identical to the vehicle connector 100 of FIGS. 1-4B, the vehicle connector 500 of FIG. 5, and/or the vehicle connector 700 of FIG. 7. Thus, those components of the vehicle connector 700 will not be described in detail below.

As illustrated in FIG. 8, the vehicle connector 800 includes three of the pushpins 702, 704, 706 and the seal 310 that includes the sensors 318. In some examples, the sensors 318 are clustered together into trailer-connection sensors. For example, the sensors 318 are clustered together into the first trailer-connection sensor 322, the second trailer-connection sensor 324, the third trailer-connection sensor 326, the fourth trailer-connection sensor 328, etc. Each of the pushpins 702, 704, 706 and the trailer-connection sensors 322, 324, 326, 328 monitor different portions of the connection between the trailer connector 108 and the vehicle connection 800 to facilitate detection of misalignment and/or partial insertion of the trailer connector 108.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or". The terms "includes," "including," and "include" are inclusive and have the same scope as "comprises," "comprising," and "comprise" respectively.

The above-described embodiments, and particularly any "preferred" embodiments, are possible examples of implementations and merely set forth for a clear understanding of the principles of the invention. Many variations and modifications may be made to the above-described embodiment(s) without substantially departing from the spirit and principles of the techniques described herein. All modifications are intended to be included herein within the scope of this disclosure and protected by the following claims.

What is claimed is:

1. A connector of a vehicle for coupling a trailer to the vehicle, the connector comprising:

a wall defining a cavity to receive a trailer connector, the cavity including an electrical prong;

a housing within the cavity;

a seal extending along at least a portion of the wall to seal the cavity and the electrical prongs within the cavity when the trailer connector is inserted into the cavity, wherein a first sensor is disposed in a first portion of the seal; and an electrical circuit comprising:

a first switch operatively coupled to the first sensor wherein the first switch is configured to actuate, based on a first sensor input of the first sensor, to a closed position, wherein the first sensor input is based on an engagement of the trailer connector and the first portion of the seal.

2. The connector of claim 1, further comprising a pushpin including a first plunger, the pushpin at least partially within the housing.

3. The connector of claim 2, wherein the pushpin further includes a body, a spring, and a contact plate.

4. The connector of claim 3, wherein the first switch is coupled to the contact plate of the pushpin.

5. The connector of claim 4, wherein the contact plate actuates to close the electrical circuit when the spring is compressed by the first plunger.

6. The connector of claim 2, wherein the electrical circuit includes a second switch and a second sensor disposed in a second portion within the seal, the second sensor operatively coupled to a second switch, wherein the second switch is configured to actuate, based on a second sensor input of the second sensor, to a closed position, wherein the second sensor input is based on an engagement of the trailer connector and the second portion of the seal.

7. The connector of claim 6, wherein the pushpin is a first pushpin, and wherein the connector includes a second pushpin operatively coupled to the second switch, the second pushpin including a second plunger.

8. The connector of claim 7, wherein the electrical circuit closes when the trailer connector engages the first plunger and the second plunger.

9. The connector of claim 7, wherein the first pushpin is located in a center of the housing and the second pushpin in located on an edge of the housing.

10. The connector of claim 6, wherein the pushpin is a central pushpin in a central location in the housing, and wherein the connector includes a plurality of edge pushpins located in a plurality of locations around the edge of the housing.

11. The connector of claim 1, wherein the seal is configured to receive a second seal from a connector of a trailer.

12. The connector of claim 1, further comprising a groove within at least a portion of the wall, wherein the seal extends along from a first side of the groove, along a circumference of the wall, to a second side of the groove.

13. The connector of claim 1, wherein the first sensor is one of: a strain gauge and a stress gauge.

14. The connector of claim 6, wherein the electrical circuit further comprises a power source and an input connection, wherein the power source is configured to apply a voltage across the electrical circuit, and wherein the input connection is configured to receive, based on the power source applying the voltage, a first input, wherein the first input is received based on the first switch being in a closed position.

15. The connector of claim 14, wherein receive the first input is further based on the second switch being in a closed position.

* * * * *